United States Patent [19]

Ashcraft et al.

[11] Patent Number: 4,822,442

[45] Date of Patent: Apr. 18, 1989

[54] FLEXIBLE ARTICLE APPLICATION APPARATUS

[75] Inventors: Glinden R. Ashcraft, Lawrenceburg, Ky.; Richard E. Gorman, Lantana, Fla.; Edward J. Kozol, Ft. Lauderdale, Fla.; Robert J. Paul, Lighthouse Point, Fla.

[73] Assignee: International Business Machines Corporation, Armonk, N.Y.

[21] Appl. No.: 32,138

[22] Filed: Mar. 27, 1987

[51] Int. Cl.[4] ..... B65C 9/14; B65C 9/18; B65C 9/42

[52] U.S. Cl. ..... 156/361; 156/541; 156/542

[58] Field of Search ..... 156/248, 540, 541, 542, 156/584, 361, 362, 366, 367, 556, 566, 567, 568; 192/12 B, 48.92, 145; 248/298, 287, 276

[56] References Cited

U.S. PATENT DOCUMENTS

| | | | |
|---|---|---|---|
| 2,541,872 | 2/1951 | Hendricks | 192/48.92 |
| 2,699,683 | 1/1955 | Casmer | 192/48.92 |
| 2,766,330 | 10/1956 | Olsen | 248/276 |
| 3,436,294 | 4/1969 | Marano | 156/361 |
| 3,736,208 | 5/1973 | Kraft et al. | 156/541 |
| 4,124,436 | 11/1978 | Pettis et al. | 156/542 |
| 4,210,484 | 7/1980 | Crankshaw et al. | 156/542 |
| 4,479,839 | 10/1984 | Tasma | 156/542 |
| 4,547,252 | 10/1985 | Lamers | 156/541 |
| 4,585,505 | 4/1986 | Matsuguchi | 156/542 |
| 4,595,447 | 6/1986 | Lindstrom | 156/542 |

FOREIGN PATENT DOCUMENTS

| | | | |
|---|---|---|---|
| 1389445 | 4/1975 | United Kingdom | 156/542 |

*Primary Examiner*—Merrell C. Cashion, Jr.
*Attorney, Agent, or Firm*—Harold H. Sweeney, Jr.; W. J. Dick; M. H. Klitzman

[57] ABSTRACT

Apparatus for handling and positioning thin flexible gummed articles which are stuck in spaced sequence to a webbing which extends along a predetermined path in the machine. A vacuum holding chuck holds the gummed articles by suction and moves horizontally causing simultaneous synchronized movement of the webbing. The webbing goes around the sharp edge of a stripping plate and the vacuum holding chuck continues its straight line motion so that the thin flexible gummed article is stripped from the webbing. The article is then positioned and pressed into contact where it is to be used. The vacuum holding chuck returns to its starting position for the handling of the next article.

5 Claims, 4 Drawing Sheets

FLEXIBLE ARTICLE APPLICATION APPARATUS

BACKGROUND OF THE INVENTION

1. Statement of the Invention:

This invention relates to an apparatus for handling thin flexible gummed articles and, more particularly, to an apparatus for stripping thin flexible gummed articles such as dampening rings from a backing and placing them in position for use.

2. Description of the Prior Art:

Dampening rings are presently applied to typewriter printwheels by hand. This is a tedious and time consuming task with a large margin for error since the rings which are made of very then flexible material must be applied to the typewriter printwheel so that its radius is maintained constant and there are no bubbles or creases. The dampening rings come in large rolls and are adherent to one side of a backing or webbing. The rings must be removed from the backing and pressed into the position on the object such as the printwheel where they are to be utilized.

U.S. Pat. No. 3,271,227 issued Sept. 6, 1966 teaches the removal of gummed labels from a backing strip by moving the backing strip carrying the labels around the edge of a stripping plate which causes the label to separate from the backing strip and fall to a position below, where a document onto which the label is to be pressed is located. The label must be sufficiently stiff to separate from the backing strip as it moves over the stripping edge.

It is the main object of the present invention to provide apparatus for removing the highly flexible thin rings from the backing web and placing them in position for use.

SUMMARY OF THE INVENTION

The invention consists of apparatus for stripping gummed, thin, flexible articles such as dampening rings for use in typewriter printwheels and placing them in position where they are to be used. The flexible articles or rings are adhered to one side of a backing web in an equally spaced sequence. The backing and adherent rings are then wound into a roll. The roll is located in the holding apparatus such that the web is moved across a stripping edge or plate. The ring is particulary located in the apparatus with the subsequent rings evenly spaced therefrom. A holding or vacuum chuck is located above the flexible ring closest to the stripping edge. The holding head is operated to descend and hold the below located ring in position on the webbing. The holding chuck or head is moved horizontally by the first transport means in synchronization with the movement of the backing web. As the ring reaches the stripping edge, the webbing goes around the edge and the ring, because of its vacuum adherence to the holding head, moves straight ahead, horizontally, causing the ring to detach or peel from the backing web. The vacuum head is moved to a new position by a second transport means, which is mounted in the first transport means, where the ring carried thereby is applied by a slight pressure to the position where it is to be used. The holding head then returns to its picking position for a further operation cycle.

REFERRING TO THE DRAWINGS

DESCRIPTION OF THE PREFERRED EMBODIMENT

Figure 2:
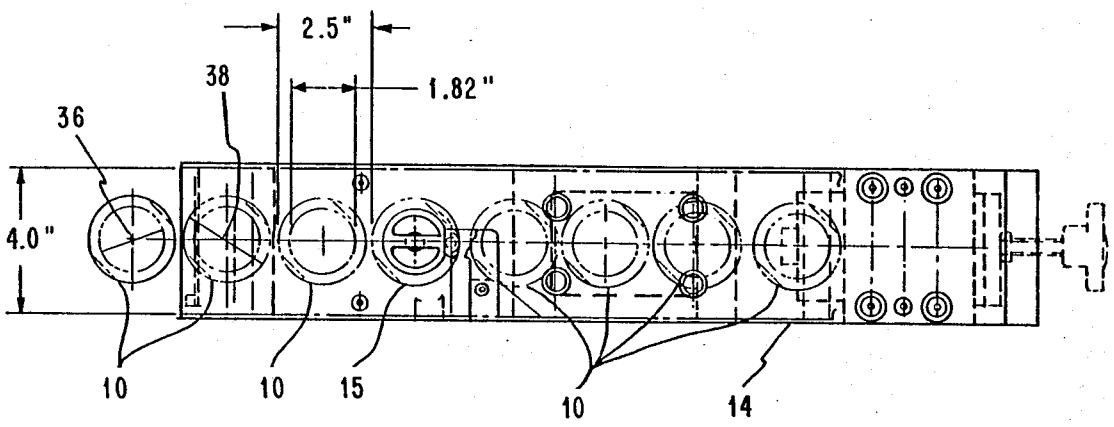
FIG. 2 is a schematic representation of a section of backing showing the gummed or sticky rings adhered thereto.

The apparatus is operable to automatically place thin flexible rings 10 on an object where they are to be used such as a daisy printwheel. The dampening rings 10 have a sticky side that adheres to the printwheel. The rings 10 are precut on a roll die. The inside diameter 36 is blanked out while the outside diameter 39 is pinched and then trimmed to the depth of the thickness of the ring and retained on the paper backing web 14. The material around the outside diameter of the ring is stripped off by the roll die, thus leaving the ring 10 on the paper web 14 surrounding the hole in the webbing which is made during the ring blanking step above. The rings 10 are approximately 0.008 inches thick and have an inside diameter of 1.82 inches and an outside diameter of 2.5 inches, shown in FIG. 2 on the flexible webbing 14 and are located on 2.56 inch centers. The acking material is generally paper which is 4 inches wide. An 18 inch diameter roll of backing material 14 contains approximately 9,000 rings 10.

Figure 1:
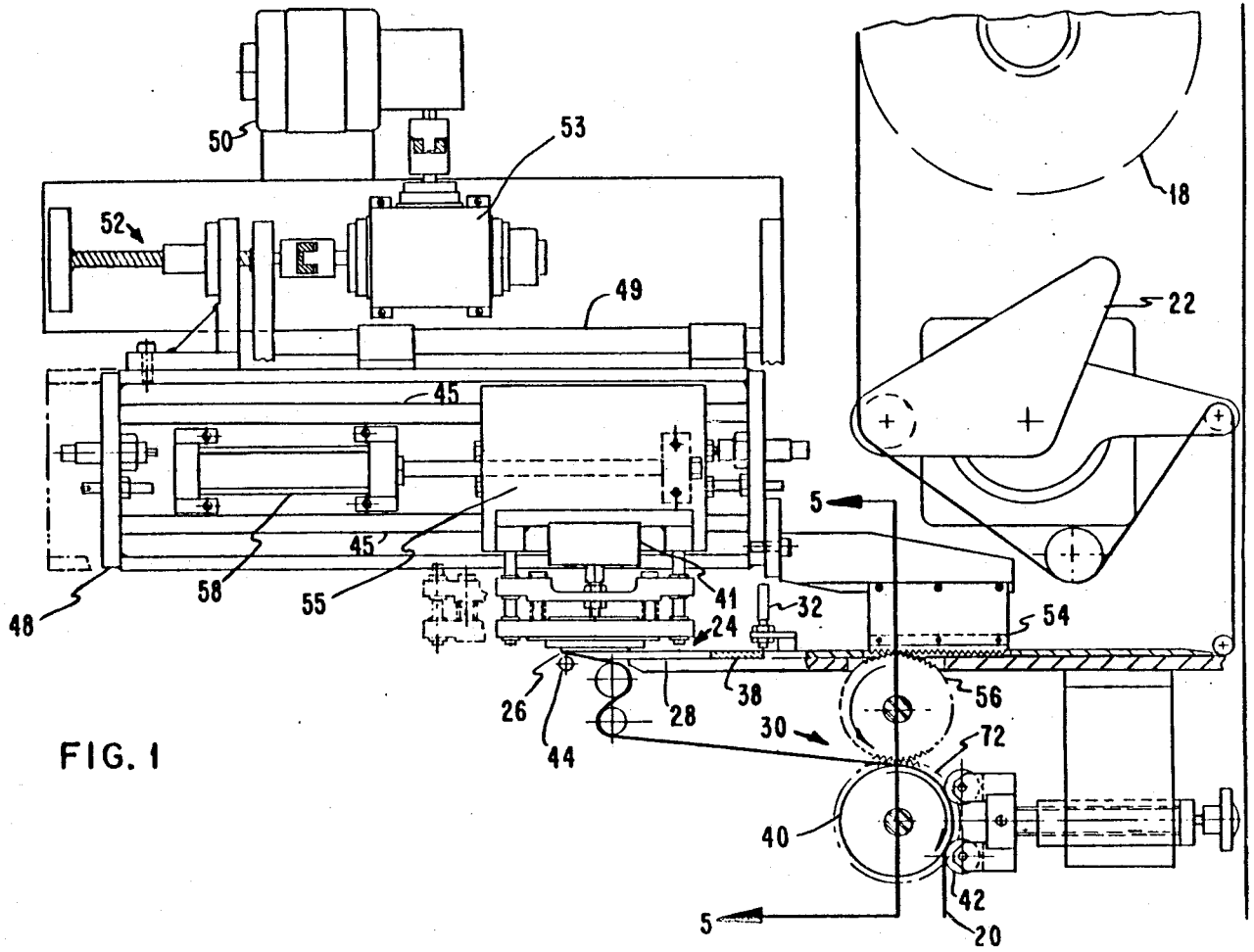
FIG. 1 is a schematic elevational view of the apparatus for removing thin flexible gummed rings from a backing and placing them in position for use.

The web or backing roll 18 is shown in FIG. 1 with the outer end 20 of the webbing threaded through the apparatus. The webbing 14 is first strung, through the compensating tension web controller 22 and then enters its horizontal run 24 through the apparatus. At the end of the horizontal run 24, the webbing is placed around the sharp edge 26 of the stripping tool plate 28 and is fed through the index drive mechanism 30. A hand-operated pilot or plug 38 is raised from the tooling plate recess and the opening or inside diameter of a ring 10 along the straight run of the web is positioned thereover. This establishes a starting position of the web 14 carrying the rings 10 in the machine. The web 14 is then pulled tight around the sharp edge 26 of the stripping plate 28 and wound around the knurled web drive roll 72 of the termittent index drive 30 and clamped to the drive by roller clamps 42.

Figure 4:
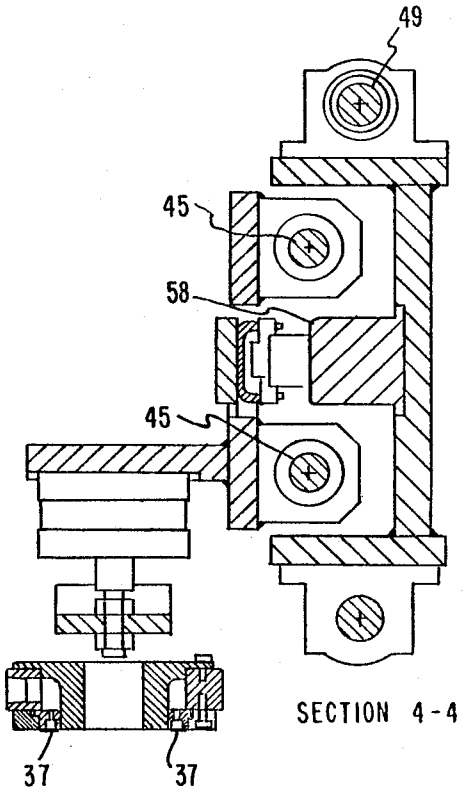
FIG. 4 is a sectional view along the line 4—4 of FIG. 3 showing more details of the vacuum head.
Figure 3:
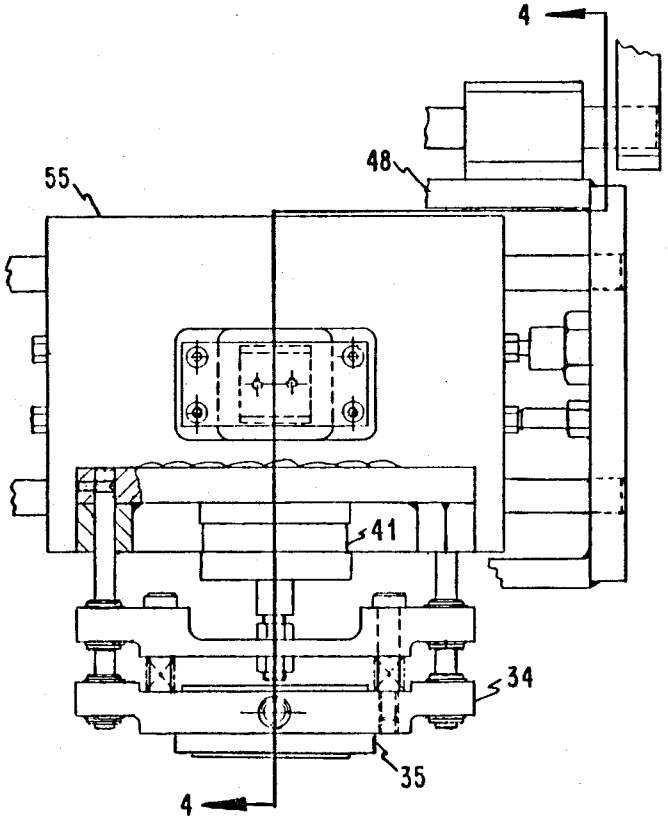
FIG. 3 is a schematic elevational view on an enlarged scale showing the vacuum head and its transport mounted in the apparatus.

A vacuum chuck 34, shown in FIG. 3, is located above the horizontal run 24 of the webbing 14 and is so located as to be above and indexed with a ring 10 preceding the ring which has its inner diameter located by the pilot 38. The vacuum chuck 34 is driven vertically up and down a fixed amount by an air cylinder 41. The bottom of the chuck 34 contains a vacuum head 35 which has its bottom surface formed of a porous stainless steel ring 37, shown in FIG. 4. In operation the vacuum chuck 34 is lowered by cylinder 40 and contacts the ring 10 located therebelow. The vacuum is energized which holds the ring 10 against the stainless steel ring 37 of the vacuum head 35. An air jet manifold 44 is energized which applies an air stream against the bottom of the webbing 14 at the ring 10 aiding the holding of the ring against the stainless steel ring 37 of the vacuum chuck 34. The air jet remains on until the vacuum chuck 34 completes its travel. The vacuum chuck 34 is moved horizontally along the horizontal path of the web 14. The vacuum chuck 34 is mounted within a transporter 48 which is mounted in the apparatus or fixed frame for movement along rail 49. The transport 48 is arranged to move horizontally 2.56 inches, which is the distance between centers of adjacent rings 10 on the web 14. The transport 48 is driven by a motor 50 and drive ball screw assembly 52.

The transport 48 has a gear rack 54 attached thereto which moves with it. The gear rack motion causes rotation of an idler gear 56 which in turn causes rotation of the knurled web drive roll 72 which pulls the web 14 through the machine the given 2.56 inches, thereby synchronizing the movement of the vacuum chuck 34 with the web 14. As the vacuum chuck 34 moves, the ring 10 held against the vacuum head ring 37 moves, since it is still stuck to the web. As the web 14 moves around the sharp edge stripping tool plate 28, the chuck 34 holding the ring 10 continues to move horizontally thus stripping the ring 10 from the webbing 14.

A photocell 32 is located along the diameter of the ring in the direction of motion, which is of the reflective type and which is set to recognize the inner diameter of the ring 10. It should be noted that this recognition of the inner diameter is made in a subsequent ring 15 following the ring 10 that is peeled or removed from the webbing 14. Thus, recognition is utilized to stop the movement of transport 48. The cylinder 40 is now energized which lifts the vacuum chuck 34 to its raised position.

The vacuum chuck 34 is carried by a transport 55 which is mounted on rails 45 for movement within transport 48. This movement is obtained by an air cylinder 58 which causes movement of the transport 55 11.5 inches, at which destination the cylinder 40 is again operated to move the vacuum holding chuck 34 down, thereby, placing the ring 10, carried thereby with the sticky side down against the printwheel around the opening therein. The vacuum chuck 34 is then raised and the transport 55 carrying the vacuum chuck 34 is returned by means of cylinder 58 to its starting position. Transporter 48 is moved in reverse via the ball screw assembly 52 and motor 50 which has a reversible clutch-brake 53 located between the motor 50 and the ball screw drive assembly 52. The reversible clutch brake 53, in the reverse setting, is operable to drive the ball screw assembly 52 to move the transport 48 in the reverse or return direction.

Figure 5:
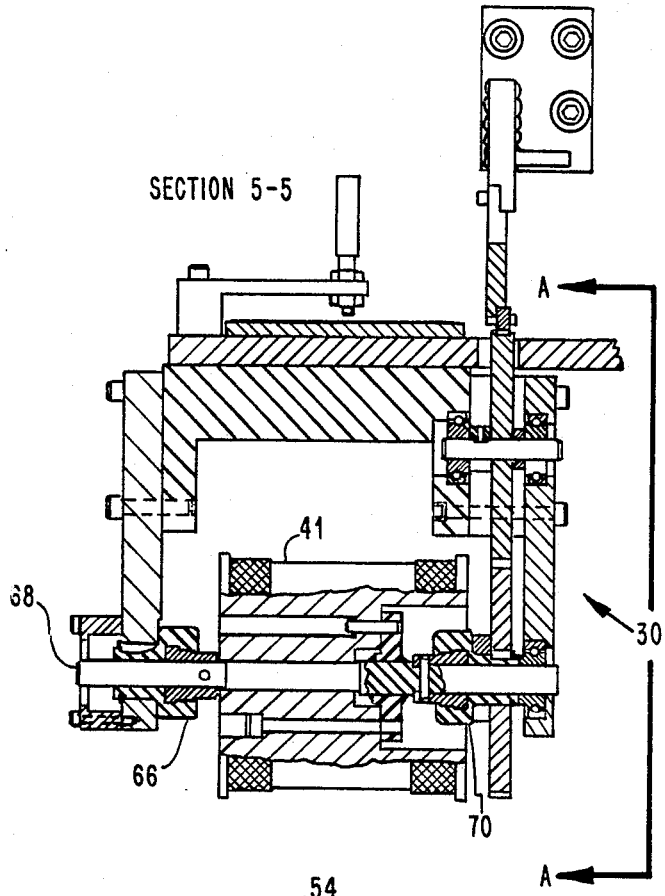
FIG. 5 is a sectional view along the line 5—5 of FIG. 1, showing the intermittent index drive for the web.
Figure 6:
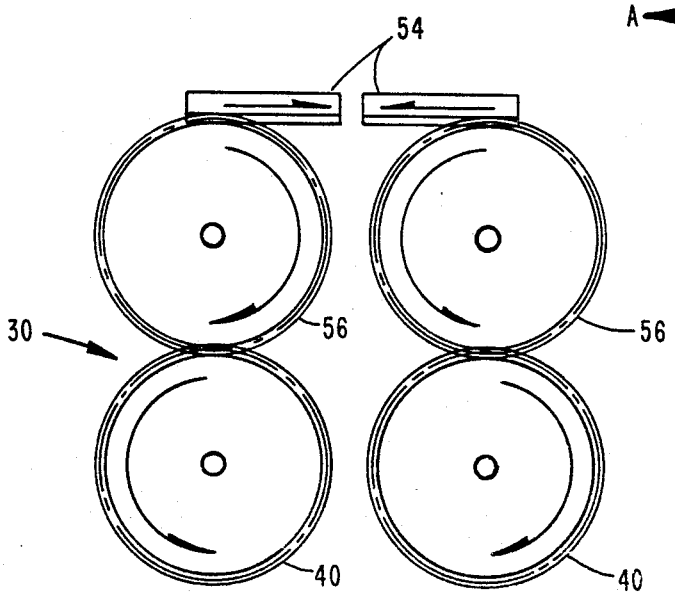
FIG. 6 is an illustrative view of the drum operations of the intermittent index drive of FIG. 5.

FIG. 5 is a cross sectional view along the line 5—5 of FIG. 1 showing the knurled web drive roll 72, the right hand clutch drive 66 and the left hand clutch drive 70. As was previously mentioned, the web 14 is fixed for rotation on the knurled drive drum 72 by clamp rolls 42. FIG. 6 shows schematically the gear rack 54 and the intermittent index drive 30, which includes the idler gear 56 and the drum drive gear 72, in two setting. The first, which is shown in the left hand half of FIG. 6, shows the gear rack 54 in the finished drive position. This would be the setting wherein the gear rack 54 carried by the transport 48 is at its extreme left hand or extended position having stripped a thin flexible ring 10 from the backing 14. In getting to this position, the clutch 66 is in the slip condition allowing the shaft 68 of the drum 40 to turn freely therein. Clutch 70 is locked to the shaft 68, thereby allowing drum 72 to rotate when the drive gear 72 is driven by idler gear 56 which is in turn driven by the gear rack 54. It should be appreciated that this arrangement of the gear rack 54, idler gear 56, and drum drive gear 72 moves the webbing 14 in synchronism with the transport 48 which in turn carries the vacuum holding chuck 34 to effect the stripping of a ring 10 from the webbing 14. A ring 10 is stripped from the webbing per each cycle of the above described apparatus.

When the transport 48 is returned to the start position, as shown in the right hand illustration of FIG. 6, the clutch 66 is energized or locked holding shaft 68 from turning. At the same time, clutch 70 slips, thereby providing no movement of the drum 40 when idler gear 56 is driven in the counter clockwise direction as indicated by the arrow thereon as a result of the gear rack 54 returning to the start position.

While there have been described what are at present considered to be a preferred embodiment of this invention, it will be obvious to those skilled in the art that various changes and modifications may be made therein without departing from the invention, and it is, therefore, intended to cover all such changes and modifications as fall within the true spirit and scope of the invention.

What is claimed is:

1. Apparatus for handling flexible gummed rings and placing them in predetermined positions for use comprising:

a backing web carrying the gummed rings stuck thereto in spaced sequence extending along a predetermined path in said apparatus;

said backing web having round openings concentric with and having the same diameter as the inner diameter of said gummed rings;

a vacuum holding head for holding a gummed ring thereon by suction;

a hand operated plug over which a gummed ring on said backing is located to reference said rings carried by said backing web in said apparatus;

a sharp edge stripping plate for aiding in the stripping of said gummed rings from said backing web;

means for lowering said vacuum holding head into contact with said gummed ring located thereunder;

a first transport means for moving said vacuum head horizontally;

a gear rack connected to and movable with said first transport means;

an index drive connected to and driven by said gear rack for linearly moving the backing web synchronously with said vacuum head carried by said first transport means so that said backing web goes around said sharp edge stripping plate and said gummed ring held by said vacuum holding head is stripped from said backing web;

a second transport means carried by said first transport means for moving said vacuum head horizontally to the predetermined position for placing said gummed rings carried thereby and;

vertical motion means for moving said vacuum head downward to place said gummed ring into position.

2. Apparatus according to claim 1, wherein an air jet is provided below said backing web carrying said gummed ring for urging said gummed ring against said vacuum head to aid the vacuum holding of said gummed ring against said vacuum head.

3. Apparatus according to claim 1, wherein a reflective type photo cell detects the inner diameter edge of a gummed ring of said sequence of gummed rings for location control.

4. Apparatus according to claim 1, wherein said index drive comprises an idler gear driven by said gear rack attached to said first transport means and a further gear meshed with said idler gear, a knurled web drive roll driven by said further gear for moving said backing web.

5. Apparatus according to claim 4, wherein said index drive further comprises a first and second drive clutch, a drive shaft through said drive roll, the first drive clutch located at the outer end of said drive shaft being deenergized when said drive gear is driven in one direction and energized when the drive gear is driven in the opposite direction, said second clutch located at the drive end of said drive shaft being energized when said first clutch is deenergized and being deenergized when said first clutch is energized thereby allowing said knurled web drive roll to intermittently rotate in one direction only.

* * * * *